US007377280B2

(12) United States Patent
Bokelman et al.

(10) Patent No.: US 7,377,280 B2
(45) **Date of Patent: *May 27, 2008**

(54) TOBACCO CURING BARN

(75) Inventors: Gordon Herman Bokelman, Chesterfield, VA (US); Maria Skandaliaris Shulleeta, Richmond, VA (US); Alfred Shahmoradian, Richmond, VA (US); Boris Lydell Kizzie, Hopewell, VA (US)

(73) Assignee: Philip Morris USA Inc., Richmond, VA (US)

( * ) Notice: Subject to any disclaimer, the term of this patent is extended or adjusted under 35 U.S.C. 154(b) by 473 days.

This patent is subject to a terminal disclaimer.

(21) Appl. No.: 10/934,732

(22) Filed: Sep. 7, 2004

(65) Prior Publication Data

US 2005/0211258 A1 Sep. 29, 2005

Related U.S. Application Data

(63) Continuation of application No. 10/060,347, filed on Feb. 1, 2002, now Pat. No. 6,786,220.

(51) Int. Cl.
*A24B 3/10* (2006.01)

(52) U.S. Cl. ..... 131/303; 432/500

(58) Field of Classification Search ..... 131/300, 131/302, 303; 34/233, 230, 235, 535, 256; 432/500

See application file for complete search history.

(56) References Cited

U.S. PATENT DOCUMENTS 2,343,345 A 3/1944 Touton (Continued)

FOREIGN PATENT DOCUMENTS

CA 557858 5/1958

(Continued)

OTHER PUBLICATIONS

Buensod, A.C., *Air Conditioning for Tobacco Manufacturing*, Architectural Record, Nov. 1952, pp. 88-89.

(Continued)

*Primary Examiner*—Carlos Lopez
(74) *Attorney, Agent, or Firm*—Buchanan Ingersoll & Rooney PC

(57) ABSTRACT

A facility and method steps for air curing tobacco in an enclosure include hanging the tobacco in the enclosure-having at least one vertically arranged air duct positioned in a central portion of the enclosure, at least one in-line fan positioned in a vertical portion of the at least one vertically arranged air duct, at least one ventilating fan located in an upper portion of the enclosure and at least one openable and closeable opening in at least one side wall of the enclosure. The humidity within the enclosure is lowered by opening the openable and closeable openings in at least one side wall of the enclosure and forcing warm air from the top of the enclosure down through the tobacco within the enclosure by operating the ventilation fans located in a top portion of the enclosure. Humidity is raised within the enclosure by closing the openable and closeable side openings and introducing water or other aqueous solutions into the vertical air ducts while operating the in-line fans within the air ducts to diffuse the moisture and drive it upwards for warming and uniform distribution throughout the barn.

7 Claims, 3 Drawing Sheets

U.S. PATENT DOCUMENTS

| | | | | |
|---|---|---|---|---|
| 2,528,982 | A | | 11/1950 | Touton |
| 2,856,937 | A | | 10/1958 | Harris |
| 3,109,637 | A | | 11/1963 | Taylor |
| 3,110,326 | A | | 11/1963 | Hassler |
| 3,337,967 | A | | 8/1967 | Smith |
| 3,503,137 | A | | 3/1970 | Wilson |
| 3,664,034 | A | | 5/1972 | Wilson |
| 3,669,429 | A | | 6/1972 | Dew |
| 3,727,556 | A | | 4/1973 | Adams |
| 3,737,323 | A | | 6/1973 | Thomas |
| 3,824,705 | A | | 7/1974 | Ives |
| 3,999,303 | A | | 12/1976 | Martin et al. |
| 4,011,041 | A | | 3/1977 | Taylor |
| 4,021,928 | A | | 5/1977 | Johnson |
| 4,069,593 | A | | 1/1978 | Huang |
| 4,079,546 | A | | 3/1978 | Huang |
| 4,148,147 | A | | 4/1979 | Steffen |
| 4,184,706 | A | | 1/1980 | Simmons |
| 4,192,323 | A | | 3/1980 | Horne |
| 4,263,721 | A | | 4/1981 | Danford |
| 4,321,758 | A | | 3/1982 | Fowler |
| 4,326,537 | A | | 4/1982 | Croslin |
| 4,337,584 | A | | 7/1982 | Johnson |
| 4,470,422 | A | | 9/1984 | Joubert et al. |
| 4,559,956 | A | | 12/1985 | De Lange et al. |
| 4,737,103 | A | | 4/1988 | Siccardi |
| 4,850,264 | A | | 7/1989 | Kiser |
| 4,960,041 | A | | 10/1990 | Kiser |
| 5,018,281 | A | | 5/1991 | Bulluck, Sr. |
| 5,125,420 | A | * | 6/1992 | Livingston ..... 131/302 |
| 5,146,977 | A | | 9/1992 | Kiser |
| 5,167,081 | A | | 12/1992 | Loyns |
| 5,431,175 | A | * | 7/1995 | Beckett et al. ..... 131/303 |
| 5,586,932 | A | | 12/1996 | Kiser |
| 5,685,710 | A | | 11/1997 | Martinez Sagrera et al. |
| 5,960,558 | A | | 10/1999 | Bourgault |
| 6,346,693 | B1 | | 2/2002 | Kasevich |
| 6,564,808 | B1 | * | 5/2003 | Hempfling et al. ..... 131/297 |
| 6,786,220 | B2 | | 9/2004 | Bokelman et al. |

FOREIGN PATENT DOCUMENTS

| | | |
|---|---|---|
| FR | 583005 | 1/1925 |
| FR | 1206397 | 2/1960 |
| IT | 265119 | 3/1929 |
| IT | 657767 | 11/1963 |
| SU | 1009-414 A | 4/1983 |

OTHER PUBLICATIONS

Curing Tobacco, [Online], Humatic Journal, [Retrieved on Apr. 7, 2003], Copyright 1993.

Curing Tobacco with Heat Exchangers, [Online], Tobacco Barn Retrofit Information, Paul E. Sumner [Retrieved Apr. 7, 2003], Jun. 2001.

* cited by examiner

TOBACCO CURING BARN

This application is a continuation application of U.S. application Ser. No. 10/060,347 entitled TOBACCO CURING BARN filed on Feb. 1, 2002, now U.S. Pat. No. 6,786,220, the entire content of which is hereby incorporated by reference.

FIELD OF THE INVENTION

The present invention relates to methods and apparatus for air curing tobacco and bringing it into condition.

BACKGROUND OF THE INVENTION

Conventional air-curing tobacco barns utilize natural convection, with air flow generally proceeding from the bottom of the barn toward the top of the barn. In curing tobacco by the procedure generally referred to as the "bulk curing" method, tobacco leaves are loaded in a relatively compact mass on racks or in containers and placed inside of an enclosed curing barn where a furnace or a plurality of heaters circulate a forced flow of heated air through the mass of tobacco leaves to effect curing and drying. Conventional tobacco curing barns attempt to obtain the desired atmospheric conditions such as temperature and humidity within the tobacco barn by various adjustments of louvers or openings in the sides of the barn and the operation of heaters spaced along the floor of the barn with respect to the prevailing temperature and moisture content of the outside atmosphere, the wind velocity and its direction with respect to the tobacco barn. A number of problems have been observed when curing tobacco in conventional air-curing barns. The different tiers of tobacco stacked in the barn cure at different rates, the tips of the tobacco leaves are often found to dry too quickly, during dry ambient weather, the tobacco may dry too quickly and have poor quality, and during humid ambient weather the tobacco may rot and have poor quality along with elevated contents of tobacco specific nitrosamines.

SUMMARY OF THE INVENTION

In view of the above-noted problems with conventional methods and apparatus for curing tobacco, an embodiment of the present invention includes the aspects of an enclosure in which tobacco plants can be air cured, at least one vertically arranged air duct positioned in a central portion of the enclosure, the at least one vertically arranged air duct enclosing at least one in-line fan positioned in a vertical portion of the at least one vertically arranged air duct, at least one ventilating fan located in an upper portion of the enclosure, and at least one openable and closeable opening in at least one side wall of the enclosure. Temperature and humidity sensors can also be provided both inside and outside of the enclosure, with a programmable control system receiving input from the temperature and humidity sensors and providing controlling output to at least one of the in-line fan, the ventilating fan and/or the openable and closeable openings in the side of the enclosure.

According to another aspect of the invention, a method for air curing tobacco includes the tobacco being hung in an enclosure having at least one vertically arranged air duct positioned in a central portion of the enclosure, at least one in-line fan positioned in a vertical portion of the at least one vertically arranged air duct, at least one ventilating fan located in an upper portion of the enclosure and at least one openable and closeable opening in at least one side wall of the enclosure, with the method including the steps of opening the at least one opening, and operating the at least one ventilating fan to force air down through the tobacco from the upper portion of the enclosure. In another aspect of the invention the method of curing tobacco can include the steps of closing the at least one opening and introducing an aqueous solution or steam into a lower portion of the at least one vertically arranged air duct and operating the at least one in-line fan to diffuse the moisture and drive it upwards through the vertically arranged air duct.

BRIEF DESCRIPTION OF THE DRAWINGS

The above and other aspects and advantages of this invention will be apparent upon consideration of the following detailed description, taken in conjunction with the accompanying drawings, in which like reference characters refer to like parts throughout, and in which.

DETAILED DESCRIPTION OF THE PREFERRED EMBODIMENTS

An embodiment of the invention includes the aspects of a specially designed mechanical ventilation and control system that can be installed in a standard burley tobacco air curing barn or provided as part of the construction of a totally new barn or other enclosure. A programmable control system uses the input from internal and external temperature and humidity sensors to start and stop the ventilation system automatically in order to maintain specified humidity levels within the barn during the curing cycle. Fans are also used to maintain uniform humidity and temperature within the barn.

Figure 1C:
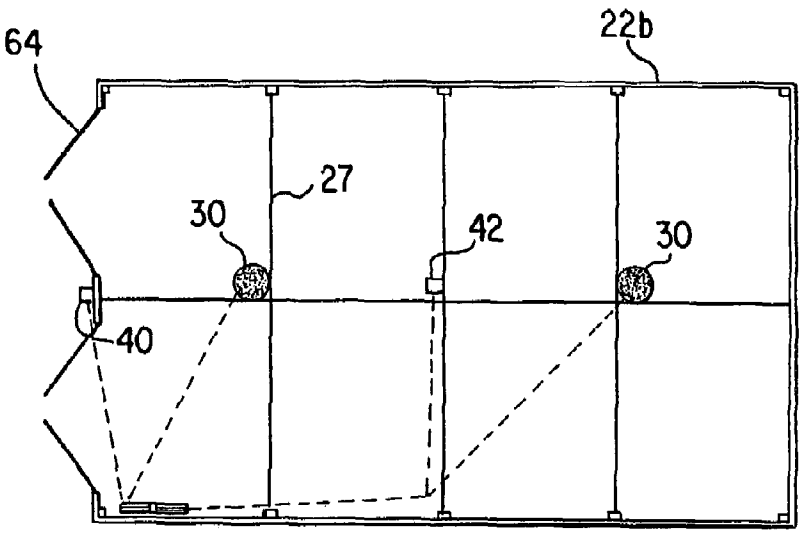
FIG. 1C is a top plan view of the enclosure shown in FIG. 1A.
Figure 1A:
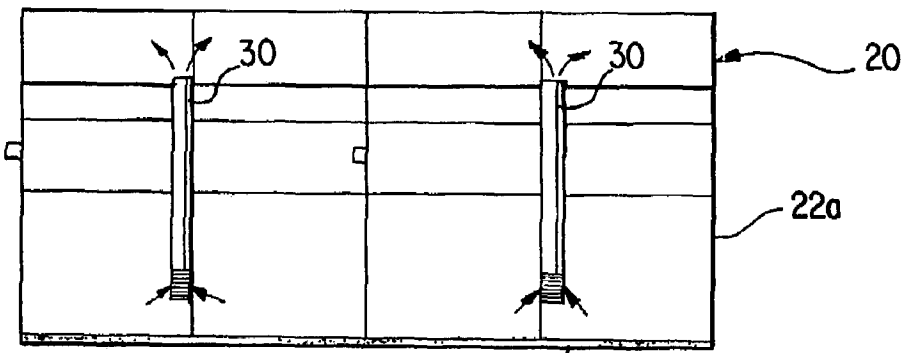
FIG. 1A is a side-elevation view of an enclosure for curing tobacco according to an embodiment of the invention.
Figure 1B:
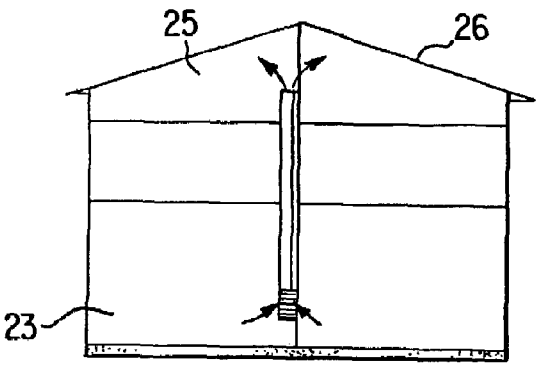
FIG. 1B is a front elevation view of the enclosure shown in FIG. 1A.

Referring initially to FIGS. 1A-1C, an enclosure 20 according to an embodiment of the invention includes side walls 22*b*, end walls 22*a*, a floor 24 and a roof 26. At least one set of large double doors 64 can be provided at one or both ends of the enclosure 20. In the embodiment shown, two vertically arranged air circulation ducts 30 are supported at spaced intervals along the central portion of the enclosure and can be supported using known construction methods by internal structural supports within the enclosure 20.

Figure 2C:
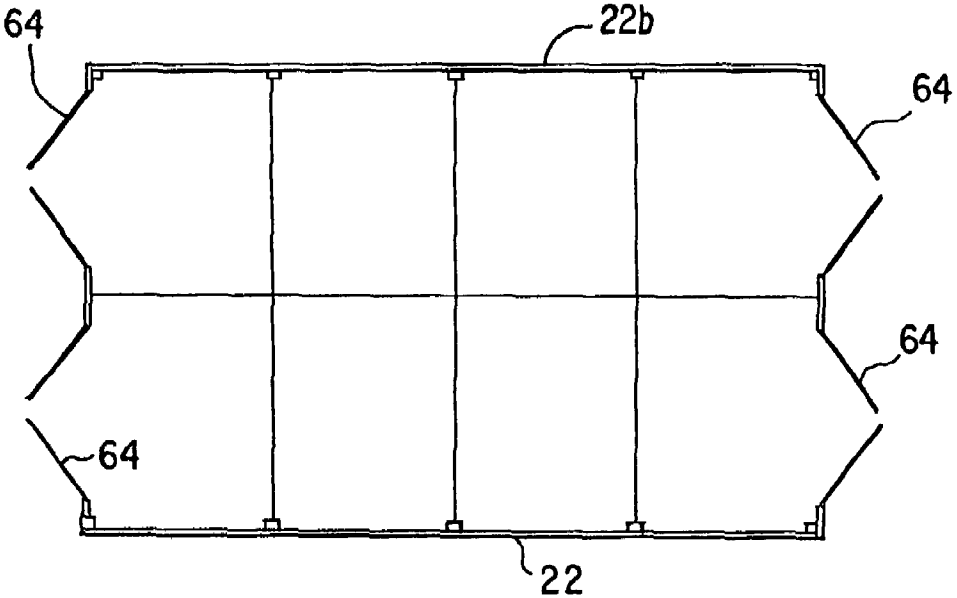
FIG. 2C is a top plan view of the enclosure shown in FIG. 2A.

As shown in FIG. 2C, the large double doors 64 can be provided at both ends of the enclosure 20 (e.g., the eight doors can each be six feet wide and ten feet high). Operable louvers 60 and 62 can also be provided at spaced intervals through the side walls 22*b* of the enclosure. The louvers 60, 62 can be opened and closed by any of a known variety of actuators that are actuated by a central programmable control system. Ventilating fans 50 can also be provided in the end walls of the enclosure at an upper portion 25 of the enclosure below the roof 26. The ventilating fans 50 are operable to direct the flow of the air to and from the upper portion 25 of the enclosure 20.

Figure 2A:
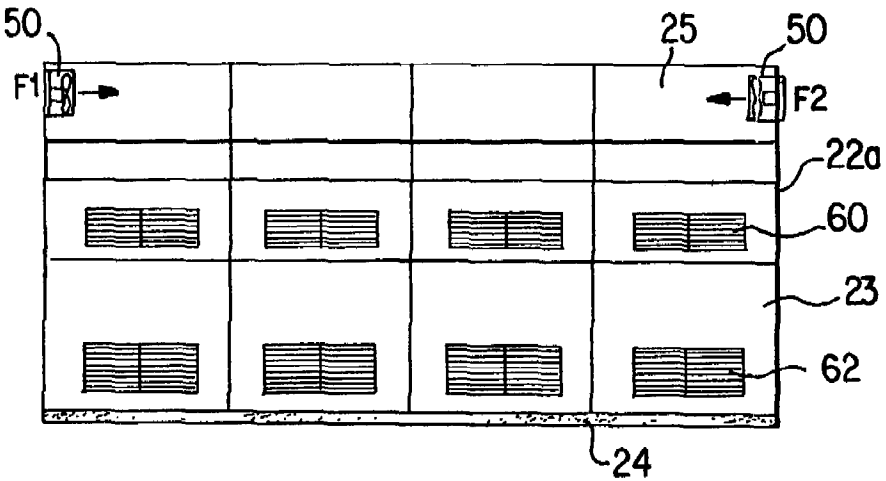
FIG. 2A is a side elevation view of an enclosure according to an embodiment of the invention.
Figure 2B:
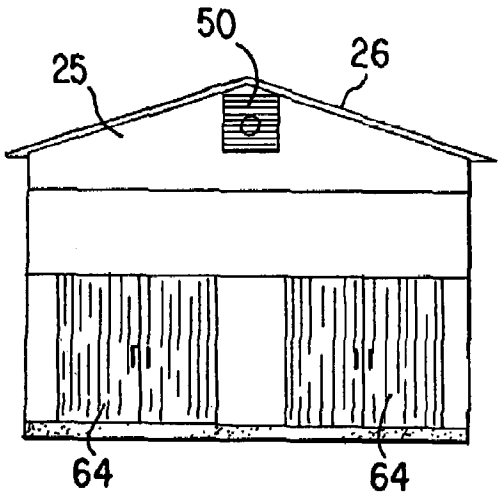
FIG. 2B is a front elevation view of an enclosure according to an embodiment of the invention.
Figure 3:
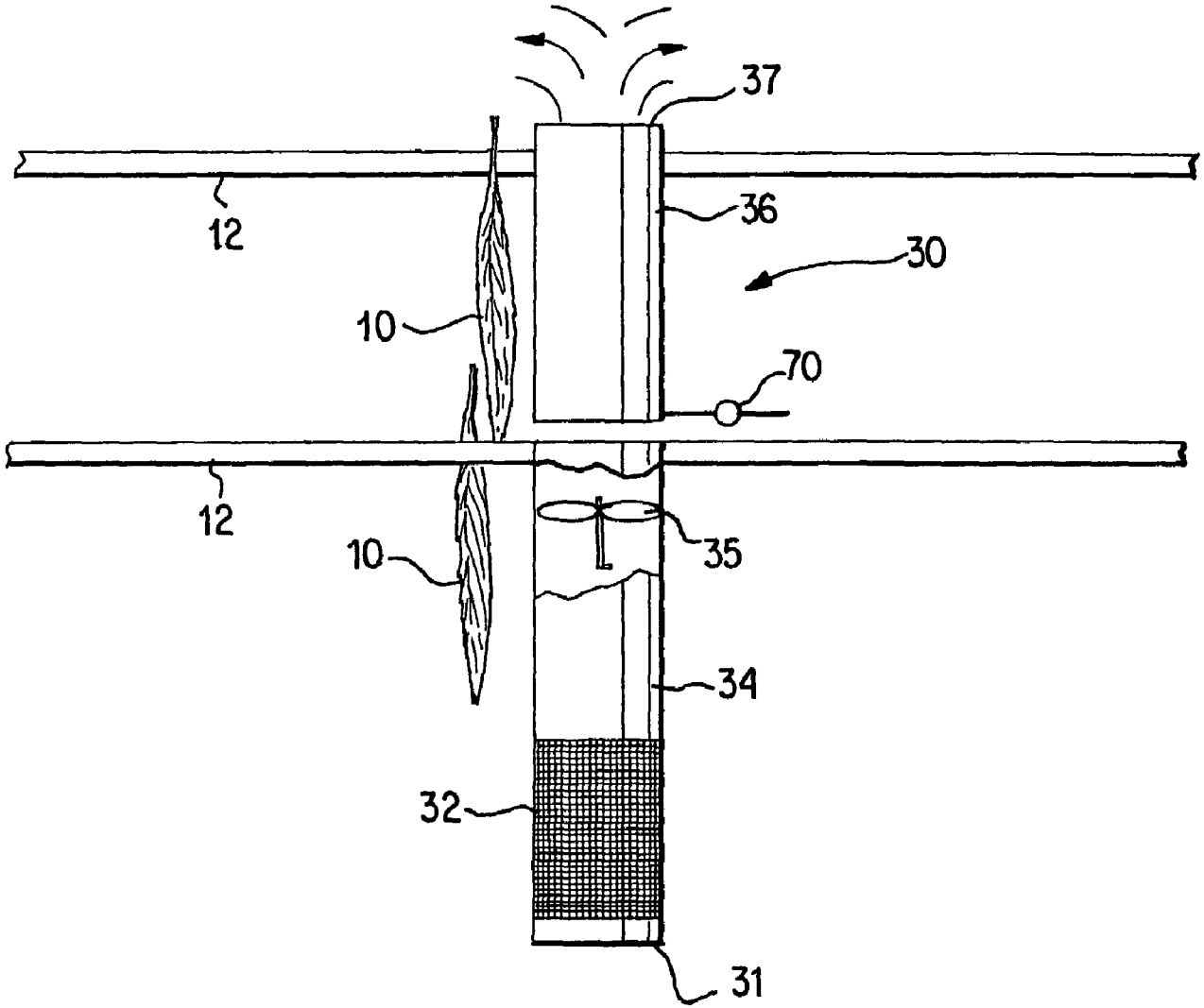
FIG. 3 is a side elevation view of a vertical air circulation duct according to an embodiment of the invention.

Referring to FIG. 3, details of the centrally located and vertically arranged air circulation ducts 30 are shown. Burley tobacco plants 10 are hung on racks 12 inside the enclosure 20 which can have any desired size (e.g., 48 feet long, 28 feet wide and 18 feet high at the lower roof line). Internal structural members can be used to support the air duct 30 in a substantially vertical arrangement at a central portion of the enclosure 20. The air ducts 30 are formed by a galvanized round steel air duct extending from a lower end 31 to an upper end 37. Although a round galvanized steel air duct is shown and preferred, the air duct can be made from other materials such as aluminum, stainless steel or even plastics, and the cross sectional configuration of the air duct can have other geometries such as a rectangular or square configuration. The lower portion 34 of the galvanized steel air duct can be provided with a wire mesh section 32 or other porous medium that allows for air flow into the bottom of the air duct 30 from a lower portion 23 of the enclosure 20, as shown in FIGS. 1B and 2A. An in-line fan 35 is mounted within a vertically oriented portion of the air duct and can be operated to move air vertically through the air duct. Baffles or other adjustable or non-adjustable partitions can be provided within an upper portion 36 of the air duct to act as an air diffuser. A device for spraying water or other aqueous solutions, such as a water spray humidifier 70 can also be provided in conjunction with the vertically arranged air duct 30 to inject a mist of water or other aqueous solutions into the air flowing through the duct at a position either above or below the in-line fan 35. Alternatively, steam can be introduced into the duct at a position either above or below the in-line fan 35.

Outdoor temperature and humidity sensors 40, as shown in FIG. 1C, and indoor temperature and humidity sensors 42 provide input to a programmable control system that uses the input from the sensors to start and stop the ventilation system automatically in order to maintain specified humidity levels during the curing cycle.

A method to operate the above-described facility during a curing operation can include the aspects of lowering humidity within the enclosure by opening the side louvers 60, 62, for example when the outdoor humidity is lower than indoor humidity, and forcing warm air from the top portion 25 of the enclosure 20 down through the tobacco by turning on the ventilation fans 50 located in the end walls 22*a* just below the roof 26 of the enclosure 20. In another aspect of the method according to an embodiment of the invention, the humidity within the enclosure can be raised by closing the side louvers 60, 62 and introducing steam or spraying water or other aqueous solutions using a device such as the water spray humidifier 70 shown in FIG. 3 into the vertical air ducts 30 while operating the in-line fans 35 to diffuse the moisture and drive it upwards for warming and uniform distribution throughout the enclosure 20.

Other aspects of operating the facility according to an embodiment of the invention can include steps for disinfecting the tobacco that is being cured within the enclosure 20. Disinfecting steps can be carried out by introducing a gaseous or an aqueous solution of chlorine dioxide or other disinfectant substances in gaseous or liquid form into the air flowing through the vertical air ducts 30. The aqueous solution of chlorine dioxide or other disinfectant substances in gaseous or liquid form is diffused and driven out of the top portion 37 of the vertical air ducts for uniform distribution throughout the enclosure 20.

The above-described system and steps can be used in conjunction with other procedures as part of a total tobacco management system. As an example, the water load going into the curing facility can be significantly influenced by choosing whether to first subject the tobacco to a pre-wilting step of approximately 3 to 7 days duration prior to loading the tobacco into the curing facility. Furthermore, during a cool and damp curing season, heaters (not shown) can be employed in the curing enclosure.

Some of the advantages of the invention include the elimination of a need for expensive air conditioning units, and the ability to produce quality cured tobacco regardless of whether the ambient weather conditions are dry, normal or humid. The methods and apparatus described above allow the tobacco to be brought into condition quickly at the end of a curing period, thereby providing labor savings for the farmer or convenience when relying on the use of migrant labor. The above-described method steps and facility may also allow a tobacco purchaser to obtain cured tobacco earlier in the season and process it so as to minimize microbial degradation. The ability to disinfect the tobacco using the above steps and facility at various stages during the curing process may also reduce formation of tobacco-specific nitrosamines, reduce or eliminate the deposition of bacterial lipopolysaccharides, and minimize microbial degradation of leaf quality during storage.

While the invention has been described in detail with reference to specific embodiments thereof, it will be apparent to those skilled in the art that various changes and modifications can be made, and equivalents employed, without departing from the scope of the appended claims.

What is claimed is:

1. A tobacco curing barn, comprising:

an enclosure in which tobacco leaves and/or plants can be air cured, the enclosure having at least one internal fan for circulating air within the enclosure, at least one ventilating fan communicating with air outside the enclosure, at least one openable and closable opening in at least one side wall of the enclosure, and a humidity system for supplying heat and/or moisture to the enclosure;

at least one internal temperature sensor in the enclosure;

at least one external temperature sensor outside the enclosure;

at least one internal humidity sensor in the enclosure;

at least one external humidity sensor outside the enclosure; and a programmable control system communicating with the internal and external temperature sensors, and the internal and external humidity sensors for monitoring purposes, communicating with the ventilating fan, the circulating fan, the openable and closable opening, and the humidity system, and operable to regulate temperature and humidity in the enclosure by controlling operation of the ventilating fan, the circulating fan, the openable and closable opening, and/or the humidity system.

2. The tobacco curing barn of claim 1, further including an additional enclosure having at least one internal fan for circulating air therein, at least one ventilating fan communicating with air outside the additional enclosure, at least one openable and closable opening in at least one side wall of the additional enclosure, and a humidity system for supplying heat and/or moisture to the additional enclosure; and wherein the programmable control system communicates with the ventilating fan, the circulating fan, the openable and closable opening, and the humidity system of the additional enclosure, and is operable to regulate temperature and humidity in the additional enclosure by controlling operation of the ventilating fan, the circulating fan, the openable and closable opening, and/or the humidity system of the additional enclosure.

3. The tobacco curing barn of claim 1, wherein the humidity system is a steam supply system.

4. The tobacco curing barn of claim 1, wherein the humidity system is a water supply system.

5. The tobacco curing barn of claim 1, further including a disinfectant supply system for supplying disinfectant to the enclosure.

6. The tobacco curing barn of claim 5, wherein the disinfectant supply system delivers fluid disinfectant to the enclosure.

7. The tobacco curing barn of claim 6, wherein the disinfectant supply system delivers chlorine dioxide.

* * * * *